US006848914B2

(12) United States Patent
Beaman et al.

(10) Patent No.: US 6,848,914 B2
(45) Date of Patent: Feb. 1, 2005

(54) ELECTRICAL COUPLING OF SUBSTRATES BY CONDUCTIVE BUTTONS

(75) Inventors: Brian S. Beaman, Apex, NC (US); William L. Brodsky, Binghamton, NY (US); James A. Busby, Vestal, NY (US); Benson Chan, Vestal, NY (US); Voya R. Markovich, Endwell, NY (US); Charles H. Perry, Poughkeepsie, NY (US)

(73) Assignee: International Business Machines Corporation, Armonk, NY (US)

( * ) Notice: Subject to any disclaimer, the term of this patent is extended or adjusted under 35 U.S.C. 154(b) by 384 days.

(21) Appl. No.: 09/975,213

(22) Filed: Oct. 11, 2001

(65) Prior Publication Data

US 2003/0073329 A1 Apr. 17, 2003

(51) Int. Cl.[7] ..... H01R 12/00
(52) U.S. Cl. ..... 439/66
(58) Field of Search ..... 439/66, 91, 86, 439/71

(56) References Cited

U.S. PATENT DOCUMENTS 4,090,768 A 5/1978 Tregoning
5,427,535 A * 6/1995 Sinclair ..... 439/66
5,540,594 A 7/1996 Collins et al.
5,567,179 A * 10/1996 Voltz ..... 439/578
6,059,579 A * 5/2000 Kresge et al. ..... 439/66
6,062,879 A * 5/2000 Beaman et al. ..... 439/91
6,080,936 A 6/2000 Yamasaki et al.
6,224,396 B1 * 5/2001 Chan et al. ..... 439/71
6,264,476 B1 * 7/2001 Li et al. ..... 439/66

* cited by examiner

*Primary Examiner*—Ross Gushi
(74) *Attorney, Agent, or Firm*—Schmeiser, Olsen & Watts; William H. Steinberg

(57) ABSTRACT

A structure and method for electrically coupling two substrates (e.g., a printed wiring board and an electronic module). Initially, a dielectric core is provided. A conductive wiring is helically wound circumferentially around the dielectric core. Additionally, a dielectric jacket may be formed around the conductive wiring. The resultant conductive rod structure is cut axially along the length of the conductive rod to generate conductive buttons having end contacts. The end contacts of the conductive buttons may be used to electrically couple the two substrates at corresponding pads of the two substrates.

67 Claims, 12 Drawing Sheets

ELECTRICAL COUPLING OF SUBSTRATES BY CONDUCTIVE BUTTONS

BACKGROUND OF THE INVENTION

1. Technical Field

The present invention discloses a method and structure for electrically joining two substrates.

2. Related Art

FIG. 1 depicts a top view of a substrate 10 with a two-dimensional array of electrically conductive pads 12 (e.g., gold or gold-plated pads) on a surface of the substrate 10, in accordance with the related art. The substrate 10 is an electrical substrate such as, inter alia, a printed wiring board or an electronic module (e.g., a module of a chip carrier with one or more attached semiconductor chips).

FIG. 2 depicts a cross-sectional view of an electrical structure 13 comprising substrates 14 and 18, each such substrate being of the type shown in FIG. 1. As an example, the substrate 18 may include a printed wiring board and the substrate 14 may include an electronic module. The substrate 14 has electrically conductive pads 16, and the substrate 18 has electrically conductive pads 20. A conductive coupler 22 permanently electrically couples the substrate 14 to the substrate 18. The conductive coupler 22 may be, inter alia, a solder ball, a solder column, etc.

A problem with the related art of FIG. 2 is that electrical structure 13 is vulnerable to solder fatigue and failure at a contact surface 17 between the conductive pad 16 and the conductive coupler 22, or at a contact surface 21 between the conductive pad 20 and the conductive coupler 22. For example, the failure could result from thermal strain on the conductive coupler 22 introduced during temperature transients, said thermal strain resulting from differential coefficient of thermal expansion (CTE) between the substrate 14 and the conductive coupler 22, between the substrate 18 and the conductive coupler 22, between the substrate 14 and the substrate 18, etc. Accordingly, there is a need for a method and structure that reduces the probability of such failure.

Another problem with the related art of FIG. 2 is that the electrical structure 13 cannot be easily repaired or upgraded in the field. Accordingly, there is a need for a method and structure that facilitates repairing or upgrading the electrical structure 13 in the field.

SUMMARY OF THE INVENTION

The present invention provides an electrical structure comprising a conductive button, said conductive button including:

a dielectric core; and a conductive wiring helically wound circumferentially around the dielectric core, wherein the conductive wiring terminates in at least two end contacts at a first end of the conductive button, and wherein the conductive wiring terminates in at least two end contacts at a second end of the conductive button.

The present invention provides a method for forming an electrical structure; comprising:

providing a dielectric core;

helically winding a conductive wiring circumferentially around the dielectric core; and cutting, normal to an axis of the dielectric core, through the conductive wiring and through the dielectric core, at two locations along the axis, leaving a conductive button between the two location as having a first end and a second end, wherein the conductive wiring terminates in at least two end contacts at the first end, and wherein the conductive wiring terminates in at least two end contacts at the second end.

The present invention reduces the probability of failure of the electrical coupling between two substrates of an electrical structure. Additionally, the present invention facilitates repairing or upgrading of the electrical structure.

DETAILED DESCRIPTION OF THE INVENTION

Figure 1:
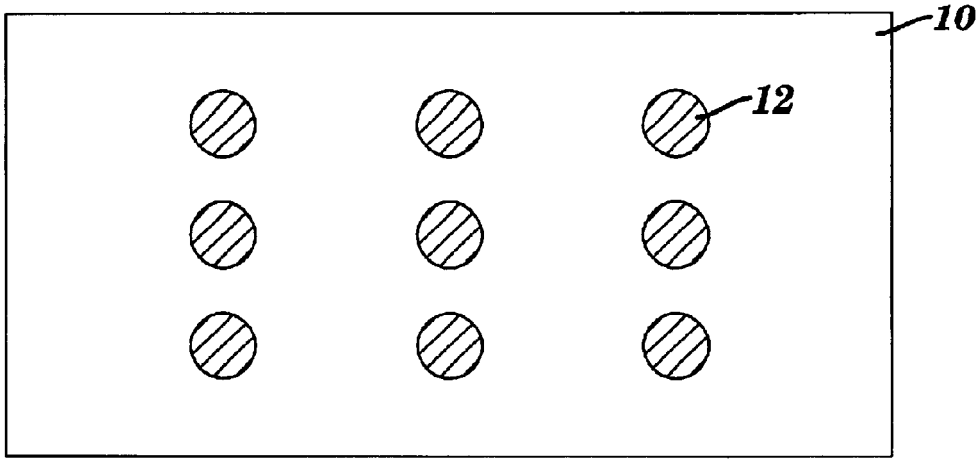
FIG. 1 RELATED ART
FIG. 1 depicts a top view of a substrate with an array of conductive pads on a surface of the substrate, in accordance with the related art.
Figure 2:
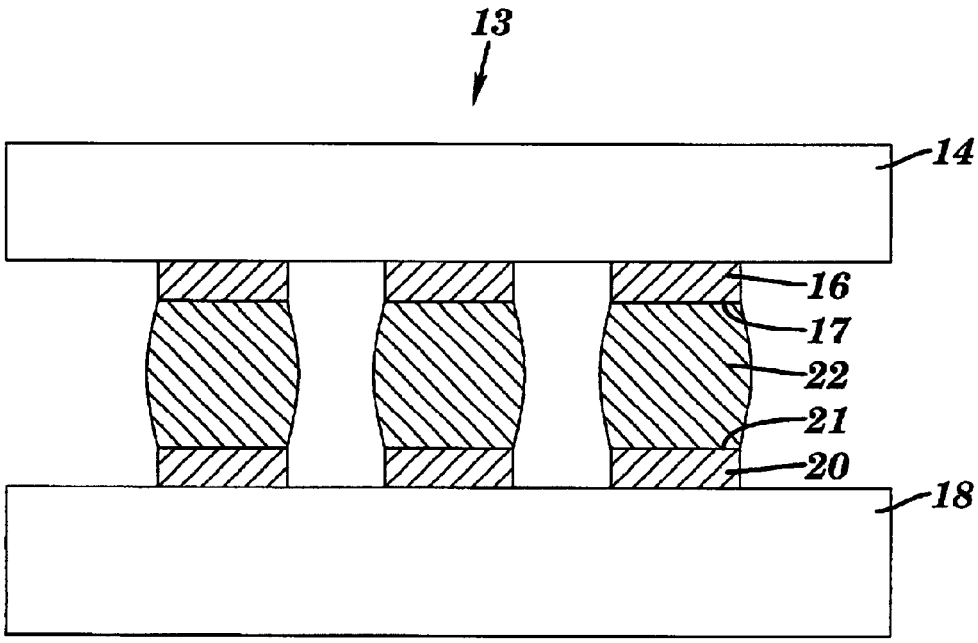
FIG. 2 RELATED ART
FIG. 2 depicts a cross-sectional view of an electrical structure comprising two substrates electrically and mechanically joined at corresponding conductive pads by a conductive button, in accordance with the related art.
Figure 3:
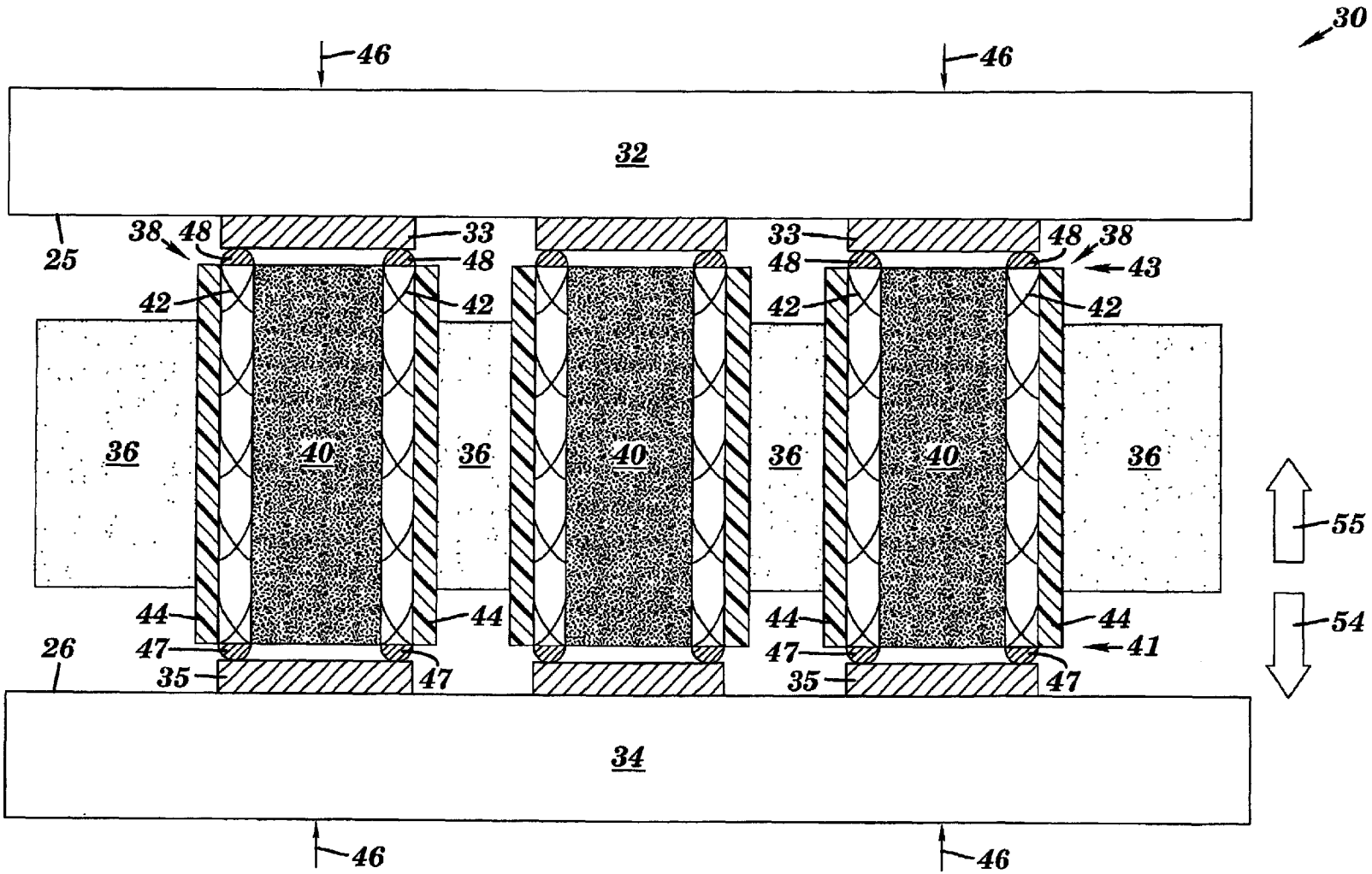
FIG. 3 depicts a cross-sectional view of two substrates electrically and mechanically coupled at corresponding conductive pads by conductive buttons, in accordance with embodiments of the present invention.

FIG. 3 depicts a cross-sectional view of substrates 32 and 34 electrically and mechanically joined at corresponding conductive pads 33 and 35, respectively, by conductive buttons 38, in accordance with embodiments of the present invention. The word, "conductive," (and variants thereof such as "conductively") herein means "electrically conductive" unless otherwise noted. The conductive pads 33 and the conductive pads 35 each constitute a two-dimensional array of electrically conductive pads (e.g., gold or gold-plated pads). The substrate 34 may include, inter alia, a printed wiring board (PWB). The substrate 32 may include, inter alia, an electronic module such as a chip carrier with one or more attached semiconductor chips.

The conductive button 38 electrically couples the substrate 32 at the pad 33 to the substrate 34 at the pad 35. Each conductive button 38 comprises a dielectric core 40, a conductive wiring 42 helically wound around the dielectric core 40, and an outer dielectric jacket 44 around the conductive wiring 42. The conductive wiring 42 terminates in the end contacts 47 at an end 41 of the button 38, where the end contacts 47 mechanically and electrically contact the pad 35. The conductive wiring 42 also terminates in the end contacts 48 at an end 43 of the button 38, where the end contacts 48 mechanically and electrically contact the pad 33. As a result, the substrate 32 is conductively coupled to the substrate 34 by the following conductive path: pad 33, end contacts 48, conductive wiring 42, end contacts 47, and pad 35.

The aforementioned mechanically and electrically contacting of the end contacts 47 and 48 to the pads 35 and 33, respectively, is accomplished by application of a compressive force 46 (e.g., clamping) on the electrical structure 30. The compressive force 46 is transmitted to the pads 33 and 35 where the transmitted force on the pads 33 and 35 is directed toward the button 38. A dielectric place holder 36 holds the buttons 38 in place. The dielectric place holder 36 is electrically insulative. Since the force 46 is capable of being released or removed, the electrical structure of FIG. 3 facilitates repairing or upgrading in the field because substrates 32 and 34 can be readily decoupled by release or removal of the force 46.

In an embodiment of the present invention, the dielectric core 40, the dielectric jacket 44, and the conductive wiring 42 are each sufficiently compressible so as to accommodate up to about 8 mils of composite variability that includes a planarity of a surface 25 of the substrate 32 and a planarity of a surface 26 of the substrate 34 which is opposite the surface 25 of the substrate 32. For example, if the substrate 32 is an electronic module then the variability in planarity of the surface 25 may be in a range of about ½ mil to about 6 mils, and if the substrate 34 is a printed wiring board then the variability in planarity of the surface 26 may be in a range of about ½ mil to about 2 mils. Thus, the dielectric core 40, the dielectric jacket 44, and the conductive wiring 42 are each compressible in a direction that is parallel to an axis of the button (i.e., in a direction 54 or 55).

The dielectric material of the dielectric core 40 or the dielectric jacket 44 may be an elastomer, and a compliance of an elastomer is related to material hardness on the Shore scale. Accordingly, the dielectric material of the dielectric core 40 or of the dielectric jacket 44 may, in particular embodiments of the present invention, have a hardness between about 37 A and about 56 D on the Shore scale.

Representative materials for the dielectric core 40 or the dielectric jacket 44 include: polytetrafluoroethylene (PTFE), expanded polytetrafluoroethylene, Hylene® TPE 9300C (Dupont), Hytrel® 4069 (Dupont), Teflon® PFA 350 (Dupont), Pellethane® 2102 (Dow), GTPO 8202 GITTO Global (Dupont), GTPO 8102 GITTO Global (Dupont), FEP 100 (Dupont), Chemigum (Goodyear), Versaflex® OM 1040 (GLS Corp.), Dynaflex® G7702 (GLS Corp), Dynaflex® G7722 (GLS Corp.), Santoprene® 8271-55 (Advanced Elastomer Systems), Dyneon® FC 2120 3M 5100. The dielectric core 40 and the dielectric jacket 44 may include a same dielectric material or different dielectric materials. In embodiments of the present invention, the dielectric core 40 has a diameter between about 10 mils and about 20 mils.

Representative materials for the conductive wiring 42 include copper, copper alloys (e.g., BeCu, phosphor bronze), nickel, palladium, platinum, and gold. To reduce or eliminate corrosion, the end contacts 47 and 48 of the conductive wiring 42 may be coated with a noble metal such as, inter alia, gold. In embodiments of the present invention, the conductive wiring 42 has a diameter between about 1 mil and about 5 mils.

FIGS. 4–11 depict steps in a fabrication of a conductive button such as the conductive button 38 in FIG. 3.

Figure 4:
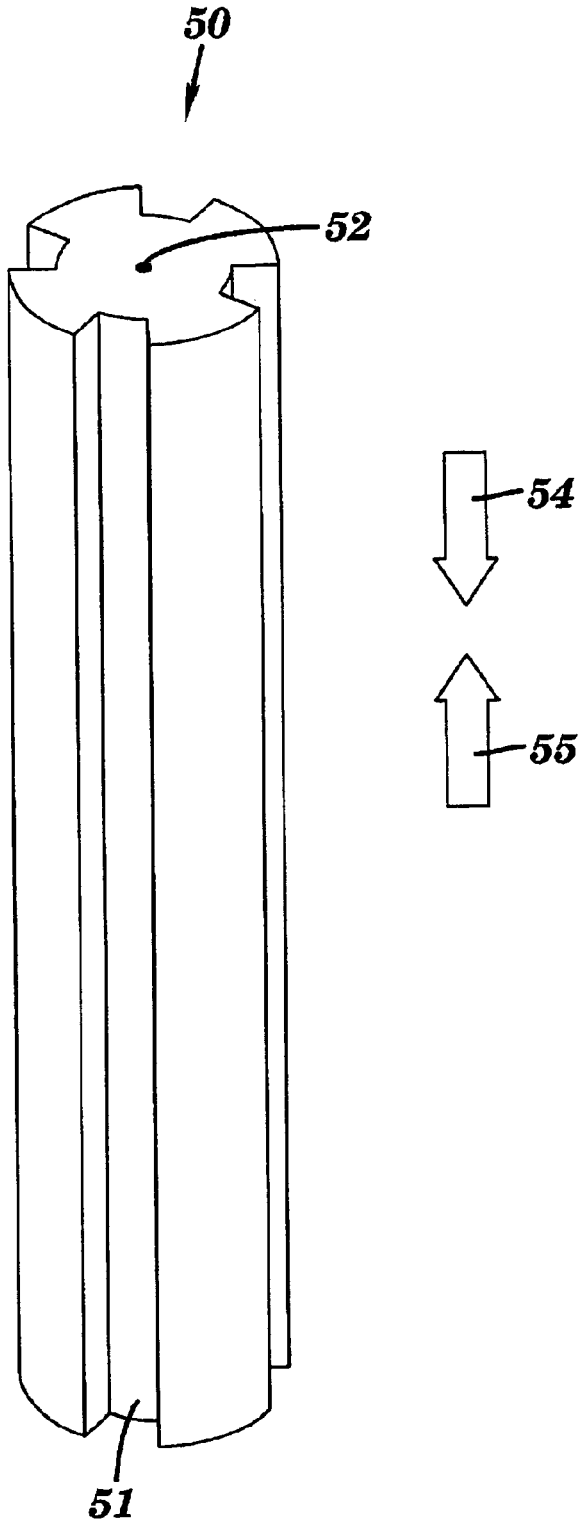
FIG. 4 depicts a perspective view of a dielectric core, in accordance with embodiments of the present invention.

FIG. 4 depicts a perspective view of a dielectric core 50, in accordance with embodiments of the present invention. The dielectric core 50 includes a dielectric material such as the dielectric material of the dielectric core 40 described supra in conjunction with FIG. 3. The outer surface of the dielectric core 50 has grooves 51 oriented axially in the direction 54 or 55, said directions 54 and 55 being parallel to the axis (or axial direction) of the dielectric core 50. The grooves 51 accommodate any hyperelasticity of the dielectric core 50 (or of the dielectric jacket 59 in FIG. 8, described infra) by providing space for the dielectric material of the dielectric core 50 to deform into. An alternative to the grooves 51 for accommodating hyperelasticity of the dielectric core 50 (or of the dielectric jacket 59 in FIG. 8) is an axial through hole in the direction 54 or 55 at a radial center 52 of the dielectric core 50. The axial through hole may be created by forming the dielectric core 50 around a solid wire and subsequently removing the solid wire to form the through hole. The solid wire provides a stiffening member during formation of the dielectric core 50 and during placement of conductive helical wiring 53 and 56 (see FIG. 5 discussed infra). The solid wire may be removed before or after the dielectric core 50 is cut to length (see FIG. 10 and accompanying discussion infra relating to cutting conductive rod 60 which contains a dielectric core). The solid wire may be retained within the dielectric core to serve as an additional electrical path between two opposing electrically conductive pads (e.g., pads 33 and 35 of FIG. 3). Another alternative for accommodating the hyperelasticity includes having the dielectric core 50 of FIG. 4 include a foamed material having internal voids or bubbles into which the dielectric material of the dielectric core 50 may deform.

The dielectric material of the dielectric core 50 and dielectric jacket 59 (see FIG. 8) may have other properties, such as: shrinking in length (i.e., in the direction 54 or 55) during exposure to heat or ultraviolet radiation; or bonding together during exposure to heat or ultraviolet radiation.

Figure 5:
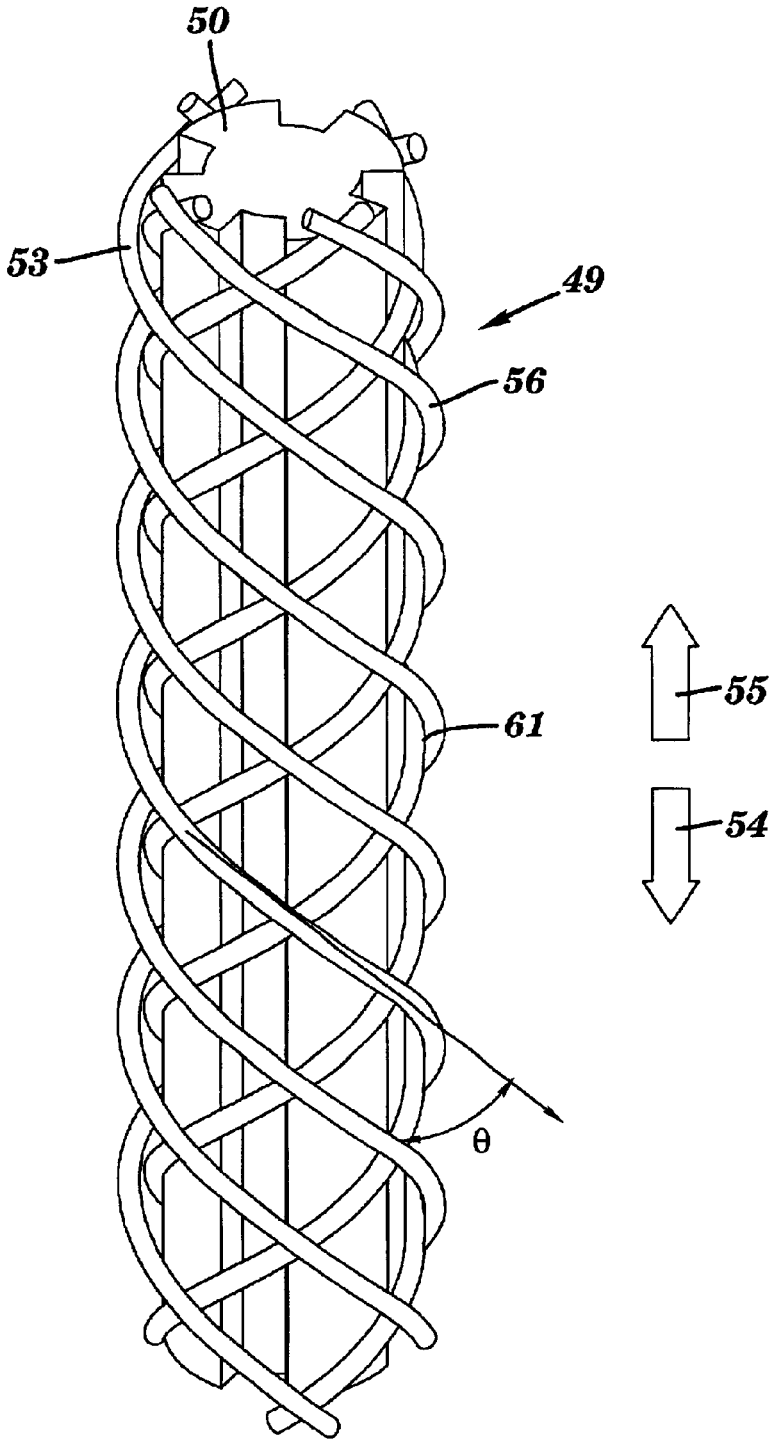
FIG. 5 is depicts conductive wiring helically wound around the dielectric core of FIG. 4.
Figure 6:
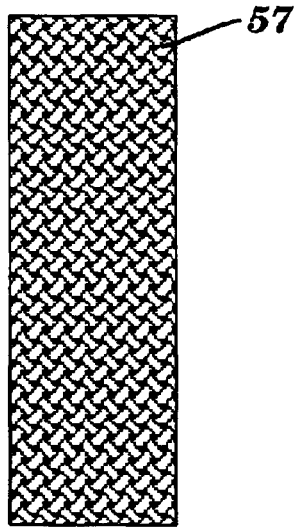
FIG. 6 depicts the helical wiring of FIG. 5 as braided.
Figure 7:
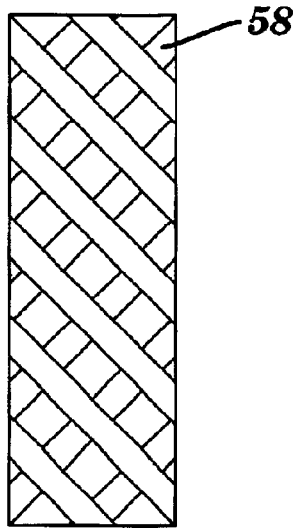
FIG. 7 depicts the helical wiring of FIG. 5 as served.

FIG. 5 depicts conductive wiring 49 helically wound around the dielectric core 50 of FIG. 4. The conductive wiring 49 includes conductive wiring 53 helically wound in a clockwise direction and conductive wiring 56 helically wound in a counterclockwise direction. The scope of the present invention includes conductive wirings 53 and 56 both present, and alternatively either but not both of conductive wirings 53 and 56 present. If the conductive wirings 53 and 56 are both present then the conductive wirings 53 and 56 may be helically would in a braided manner, resulting in a braided conductive wiring 57 shown in FIG. 6. Also if the conductive wirings 53 and 56 are both present then the conductive wirings 53 and 56 may be helically would in a served (i.e., overlaid) manner, resulting in a served conductive wiring 58 shown in FIG. 7.

FIG. 5 shows a helical angle θ of the conductive wiring 53 relative to the axis of the dielectric core 50 (i.e., relative to the direction 54). For some embodiments of the present invention, θ is between about 30 and 60 degrees.

Figure 8:
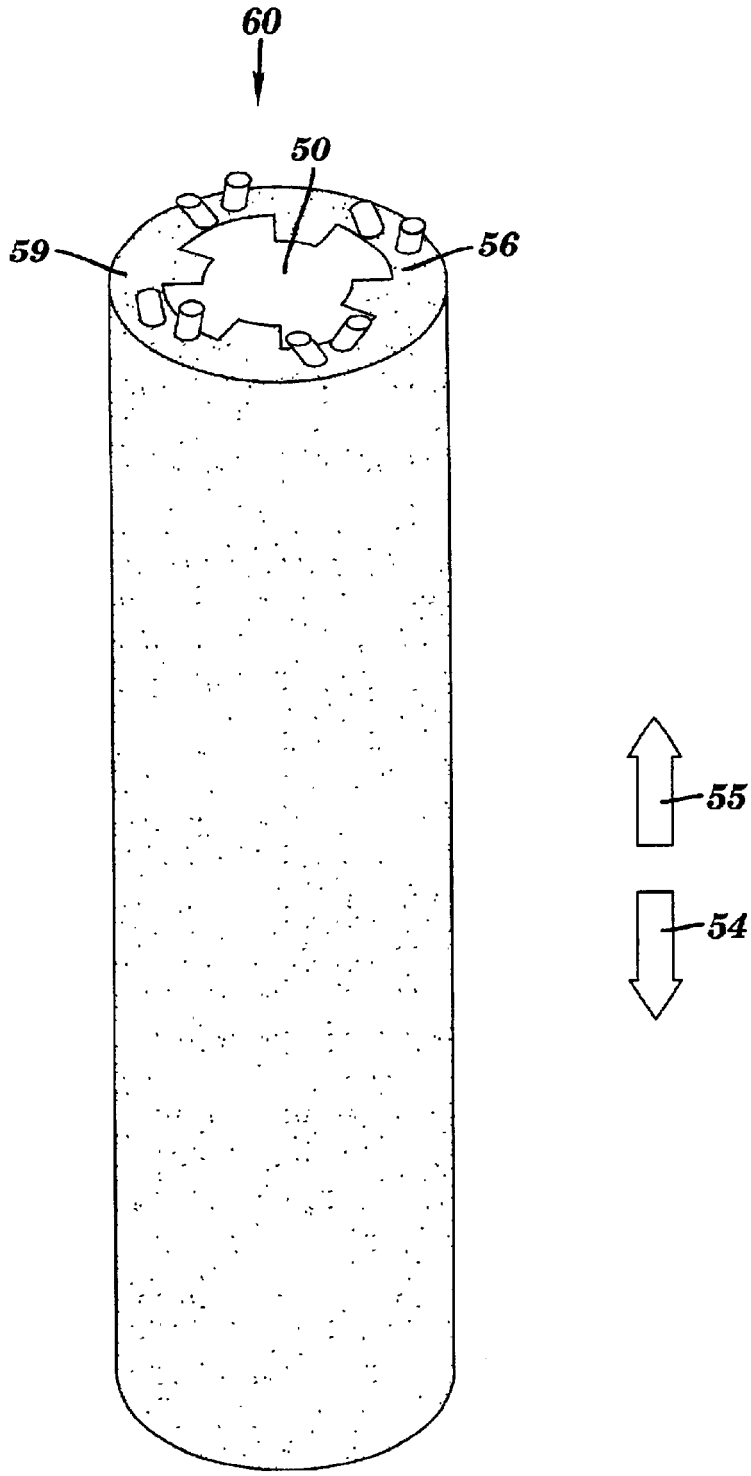
FIG. 8 depicts an outer dielectric jacket extruded onto the helically wired dielectric core of FIG. 5, thus forming a conductive rod.

FIG. 8 depicts an outer dielectric jacket 59 extruded onto the helically wired dielectric core 50 of FIG. 5, thus forming a conductive rod 60. The conductive rod 60 comprises the outer dielectric jacket 59 on the helically wired dielectric core 50.

Figure 9:
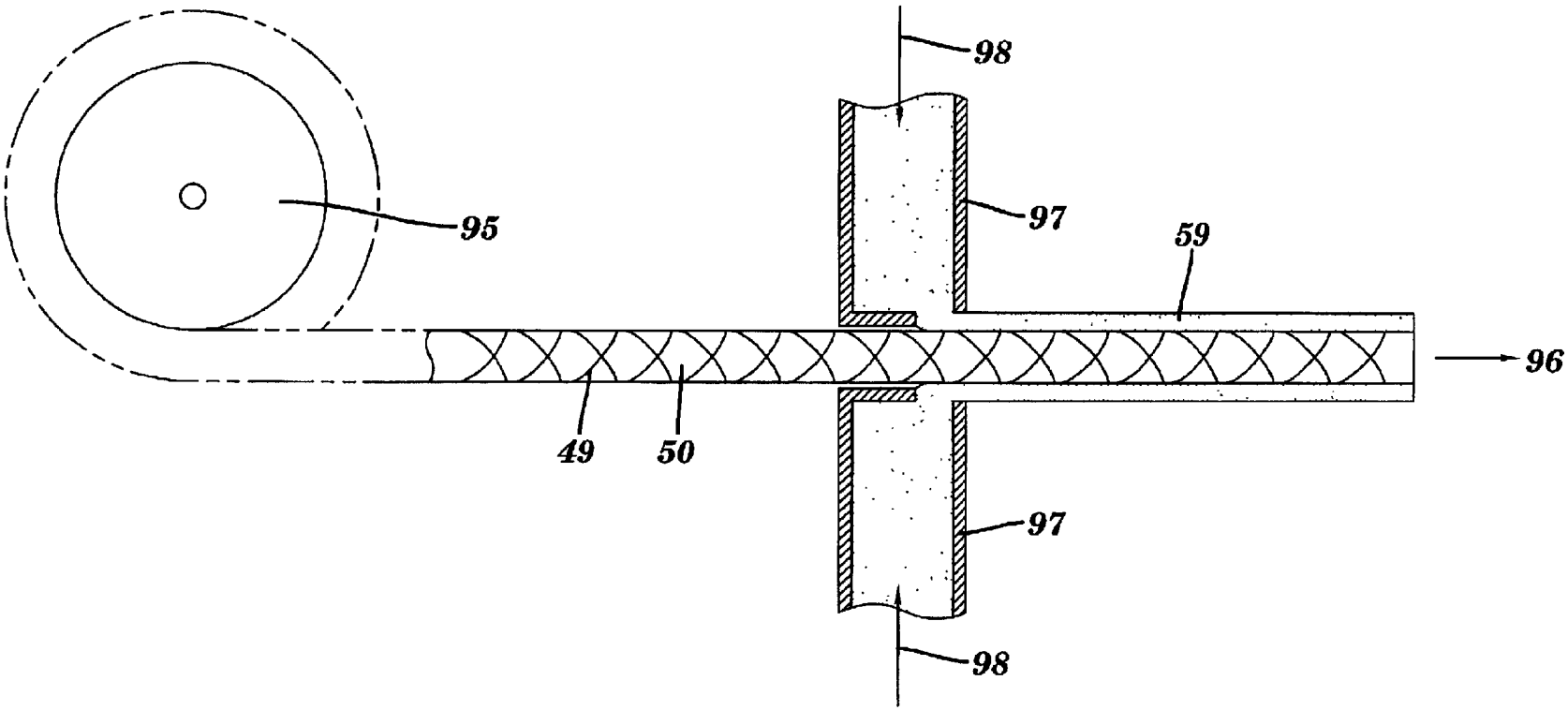
FIG. 9 depicts a cross-sectional view of the dielectric jacket extrusion process of FIG. 8.

FIG. 9 depicts a cross-sectional view of the dielectric jacket extrusion process of FIG. 8. In FIG. 9, the dielectric core 50 with helically wound conductive wiring 49 is rolled on a spool 95. The dielectric core 50 with helically wound conductive wiring 49 is shown being pulled by force 96 through extrusion die 97. While the conductive core 50 is traveling through the extrusion die 97, the outer dielectric jacket 59 is formed from melted dielectric jacket material 98 flowing through extrusion die 97 as is known in the cable making art.

Figure 10:
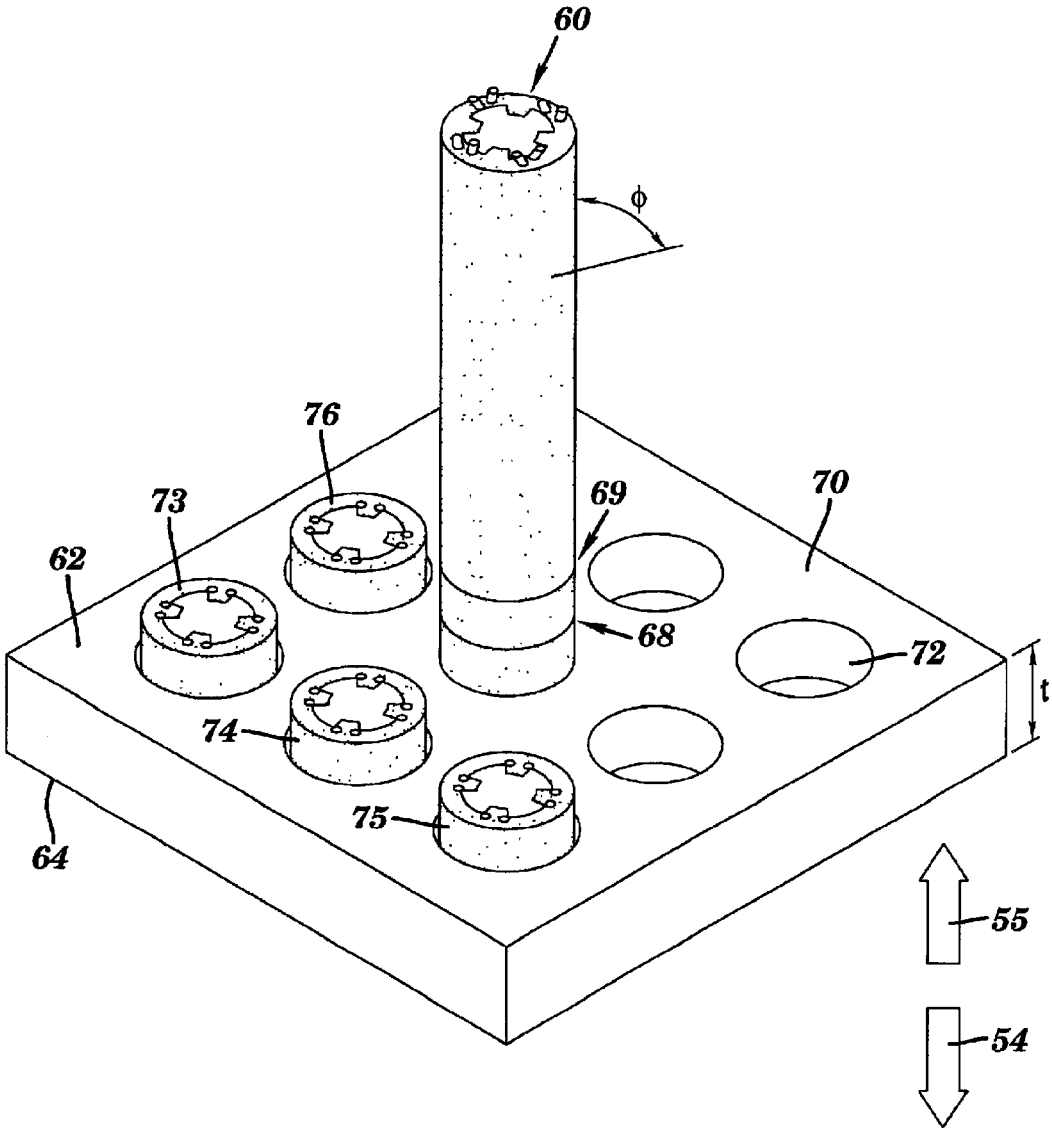
FIG. 10 depicts the conductive rod of FIG. 8 after being inserted into a dielectric place holder.

FIG. 10 depicts the conductive rod 60 of FIG. 8 after being inserted into a dielectric place holder 70 which serves to hold the conductive rod 60 in place while being subsequently cut up into the conductive buttons of the present invention and while the conductive buttons are positioned so as to mechanically and electrically couple two substrates (e.g., the substrates 32 and 34 of FIG. 3). The conductive rod 60 is fitted into a hole 72 of the place holder 70 by any suitable method such as, inter alia, friction fitting, molding, and glueing.

FIG. 10 shows cutting of the conductive rod 60 at the locations 68 and 69. The cutting may be accomplished by use of a laser (i.e., "lasering") or by any other suitable method. For example, another suitable method of cutting is mechanical cutting such as with a shearing or an electrical discharge machining (EDM) process. The cutting may be at an angle $\phi$ with respect to the direction 55, such that $\phi$ in a range of $0<\phi\leqq 90$ degrees. FIG. 10 shows conductive buttons 73, 74, and 75 after such buttons have been formed by the aforementioned cutting. In embodiments of the present invention, each conductive button may have, inter alia, a height that includes about 3 to 5 mils above a top surface 62 of the place holder 70 and about 3 to 5 mils below a bottom surface 64 of the place holder 70 for a total height that is about 6 to 10 mils greater than a thickness "t" of the place holder 70 as shown in FIG. 10.

Figure 11:
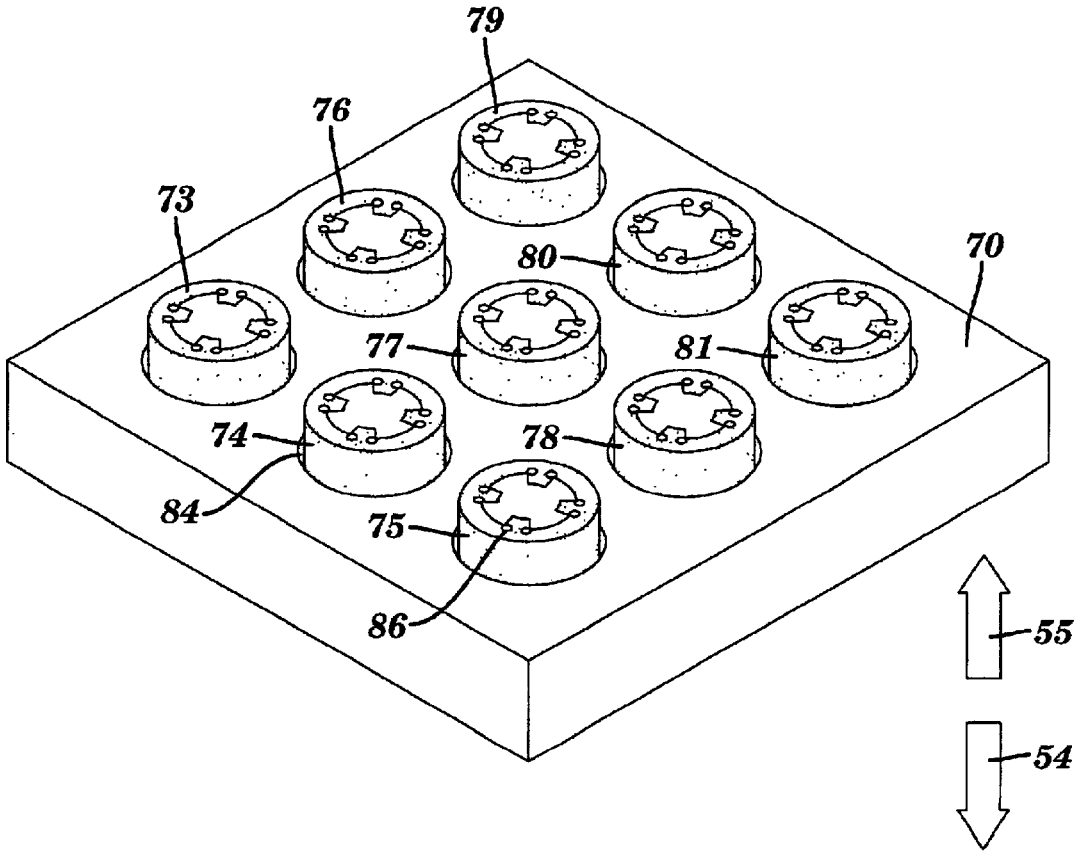
FIG. 11 depicts FIG. 10 after the conductive rod and similar conductive rods have been axially cut, leaving conductive buttons in the dielectric place holder.

FIG. 11 depicts the place holder 70 of FIG. 10 after the conductive rod 60 of FIG. 10 and similar conductive rods have been axially cut, leaving conductive buttons 73–81 in the dielectric place holder 70. FIG. 11 shows concentric through holes that have been formed in each conductive button (e.g., through hole 84 in the conductive button 74). Such through holes in the conductive buttons 73–81 in FIG. 11 exemplify the discussion supra, in conjunction with FIG. 4, of forming an axial through hole in the direction 54 or 55 at a radial center 52 of the dielectric core 50.

The conductive buttons 73–81 in FIG. 11 were formed after the conductive rod 60 (and similar conductive rods) were fitted within the place holder 70 of FIG. 10 followed by cutting the conductive rod 60 (and the similar conductive rods) into the conductive buttons 73–81. Alternatively, the conductive buttons 73–81 could have been formed by first cutting the conductive rod 60 (and the similar conductive rods) into the conductive buttons 73–81 without use of the place holder 70, followed by fitting the conductive buttons 73–81 into the place holder 70.

In FIG. 11, the end contacts formed by the method of the present invention are "raised" relative to the dielectric core and dielectric jacket. For example, the end contact 86 of the conductive button 75 is raised relative to the dielectric core and the dielectric jacket of the conductive button 75. The end contacts, as raised, are also illustrated in FIG. 3, wherein the end contacts 47 are raised (i.e., protrude in the direction 54) relative to both the dielectric core 40 and the dielectric jacket 44 of the conductive button 38, and wherein the end contacts 48 are raised (i.e., protrude in the direction 55) relative to both the dielectric core 40 and the dielectric jacket 44 of the conductive button 38. The aforementioned raising or protrusion of the end contacts 47 and 48 enables the end contacts 47 and 48 to mechanically and electrically contact conductive structure (i.e., enabling the end contacts 47 and 48 to mechanically and electrically contact the conductive pads 35 and 33, respectively, of FIG. 3). The aforementioned lasering (i.e., laser cutting) of the conductive rod 60 and similar conductive rods (see FIG. 10) facilitates the raising or protrusion of the end contacts 47 and 48 of FIG. 3, because the laser beam generally cuts a wider path (i.e., wider in the direction 54 or 55—see FIG. 10) through the dielectric core 50 and dielectric jacket 59 than through the helically wound conductive wiring.

The end contacts of the conductive buttons 73–81 in FIG. 11 may have various shapes which depend on the method used to cut the conductive rods to form the conductive buttons. For example, if a laser is used to do the cutting then the end contacts typically have a non-planar shape due to the heating effect caused by interaction of the laser radiation with the conductive wiring. As an example, the end contacts 47 and 48 in FIG. 3 have a surface curvature (e.g., spherical or elliptical) with an associated surface concavity toward the conductive button 38. A spherical or similar shape for the end contacts is desirable if the end contacts are to be mated with a substrate conductive pad that is susceptible to being damaged by contact with sharp or pointed end contacts. For example, if the conductive pad is a flat, gold pad on a surface of an electronic module, the end contact should have a spherical or similar shape so that the resultant stress on the pad will be low enough so as not to damage the gold pad, but high enough to make good electrical contact with the gold pad.

Figure 12:
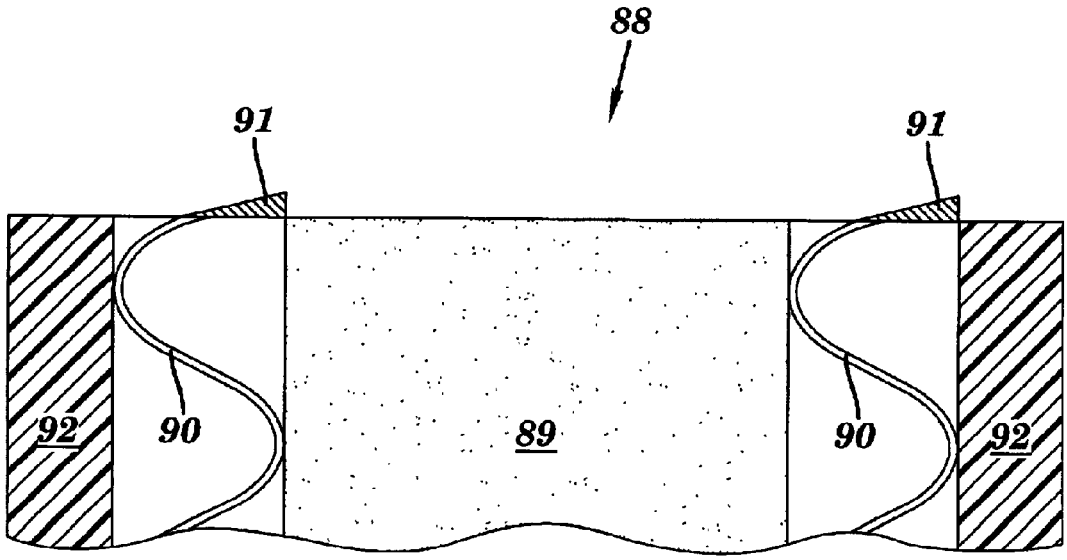
FIG. 12 depicts a cross-sectional view of end contacts of a conductive button, said end contacts created by mechanical cutting of a conductive rod from which the conductive button was formed, in accordance with embodiments of the present invention.

If the cutting is done mechanically, however, the cutting introduces a mechanical shear and creates a chisel effect with a chisel angle that is related to the helical angle of the conductive wiring. As an example, FIG. 12 illustrates a cross-sectional view of a conductive button 88 having a dielectric core 89 and conductive wiring 90 helically wound circumferentially around the dielectric core 89, and an outer dielectric jacket 92 around the conductive wiring 90. The conductive wiring 90 has end contacts 91, wherein the end contacts 91 have been generated by mechanical cutting such as with a shearing or EDM process. Due to the mechanical cutting, the end contacts 91 tend to have a chisel-like planar shape. Other shapes may be generated for the end contacts by varying the cutting method as well as the cutting details for a given cutting method. For example, the cutting device itself could be moved during the cutting process so as to vary the cutting direction (e.g., cutting height) as the cutting is occurring. To illustrate the usefulness of the chisel-like shape, a solder-coated pad has a surface oxide that needs to be penetrated by the end contacts. If the conductive wiring is cut mechanically, the resultant end contact tends to be chisel-like and sharp enough to penetrate the surface oxide and lock into the solder surface so as to contact the conductive structure of the pad.

For a conductive rod having conductive wiring made of a non-noble metal or of a non-noble metal having a noble metal plating thereon, the end contact 86 (see FIG. 11) formed by cutting may be plated, after cutting, with a noble metal plating to provide corrosion resistance.

Another technique that affect the shape of other characteristics of an end contact is to cut the conductive rod (e.g., the conductive rod 60 of FIG. 10) at a node (i.e., intersection or point of crossing) of two wires of the conductive wiring, such as at a node 61 of the intersection of the conductive wiring 53 and 56 in FIG. 5. An end contact resulting from cutting the conductive rod at such a node, in comparison with an end contact not formed at such a node; would provide a larger end contact, would be stiffer, would common the two intersecting or crossing wires together, and would give a better metallurgical coupling (i.e., a mechanically stronger coupling) between the two wires. Note, however, that cutting through the two intersecting or crossing yields only one end contact instead of two end contacts.

The multiple (e.g., a plurality) of end contacts at each end of a conductive button provides conductive redundancy, so that if one or more end contacts should fail (e.g., become conductively decoupled from a substrate pad), then conductive coupling would nonetheless persist due to the conductive functionality of other end contacts that have not failed. For example, a dielectric core of approximately 10 mils (i.e. 0.010 inches) having a circumference of approximately 31 mils can have 10 wires of 1 mil diameter in each helical direction with a spacing of approximately 3 mils. These wires can provide 10 to 20 end contacts depending how the end contacts are formed.(e.g., depending on how many of the end contacts are formed at nodes, as discussed supra).

Another feature of using the conductive buttons of the present invention to conductively couple two substrates is that the conductive buttons are less susceptible to thermal stress-induced failure than are solder interconnects (e.g., solder balls, solder columns, etc.) that conductively couple the two substrates. In particular, the conductive buttons facilitate more flexible substrate structures with a higher fatigue life than do solder interconnects, because the helically wound conductive wiring material (e.g., BeCu, beryllium, nickel, etc.) of the present invention is not as subject to as much shear as is solder in a solder interconnect. In particular, the helical winding does not give rise to a pure shear but rather to a bending stress, which results in a lower stress level in the wires. Thus, fatigue damage is accumulated at a slower rate per cycle in as much as the helical wiring pattern distributes the stresses in different directions relative to the axial direction (i.e., the direction 54 or 55 in FIG. 3).

Figure 13:
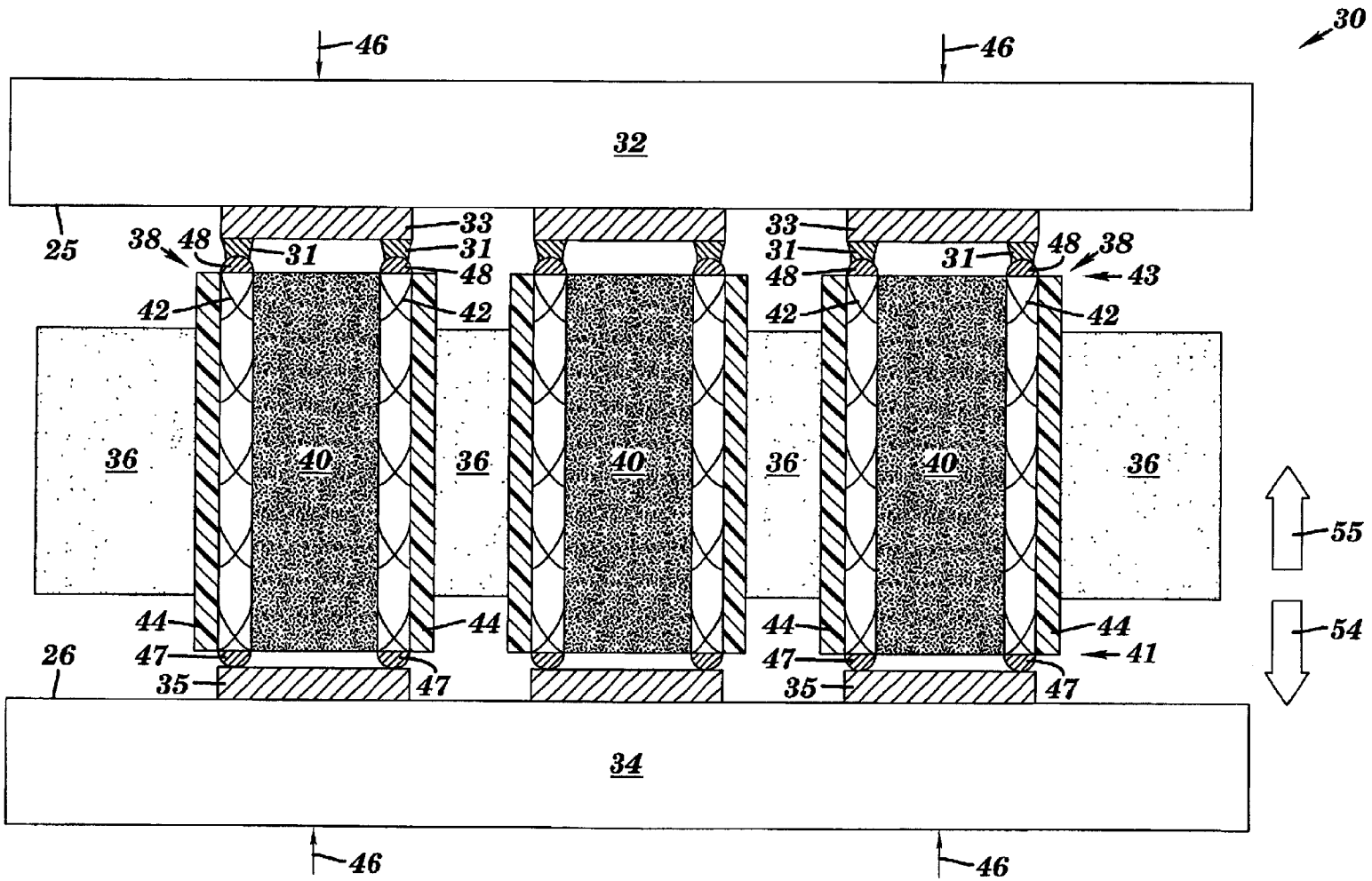
FIG. 13 depicts FIG. 3 with conductive buttons being soldered to one of the two substrates, in accordance with embodiments of the present invention.

As stated supra, the electrical structure of FIG. 3 facilitates repairing or upgrading in the field because substrates 32 and 34 can be readily decoupled by release or removal of the force 46. This feature results from the fact that the conductive buttons 38 in FIG. 3 are not permanently attached to the pads 35 and 33 of the substrates 34 and 32, respectively. Another embodiment of the present invention is to permanently attach the conductive buttons 38 to the pads 33 prior to applying the force 46 in FIG. 3. Accordingly, FIG. 13 depicts FIG. 3 with end contacts 48 of conductive buttons 38 soldered to the pads 33 of the substrate 32 prior to application of the force 46, in accordance with embodiments of the present invention. A solder interface 31 mechanically and conductively couples the end contacts 48 to the pads 33. If the substrate 32 is an electronic module and the substrate 34 is a printed wiring board, then the solder interface 31 enables the collective unit of the substrate 32 (i.e., the electronic module) and the attached conductive button 38 to be repaired or removed in the field should the substrate 32 fail during field testing or during field operation. If the substrate 32 is a printed wiring board and the substrate 34 is an electronic module, then the solder interface 31 enables the substrate 32 (i.e., the electronic module) to be repaired or removed in the field should the substrate 32 fail during field testing or during field operation.

Figure 14:
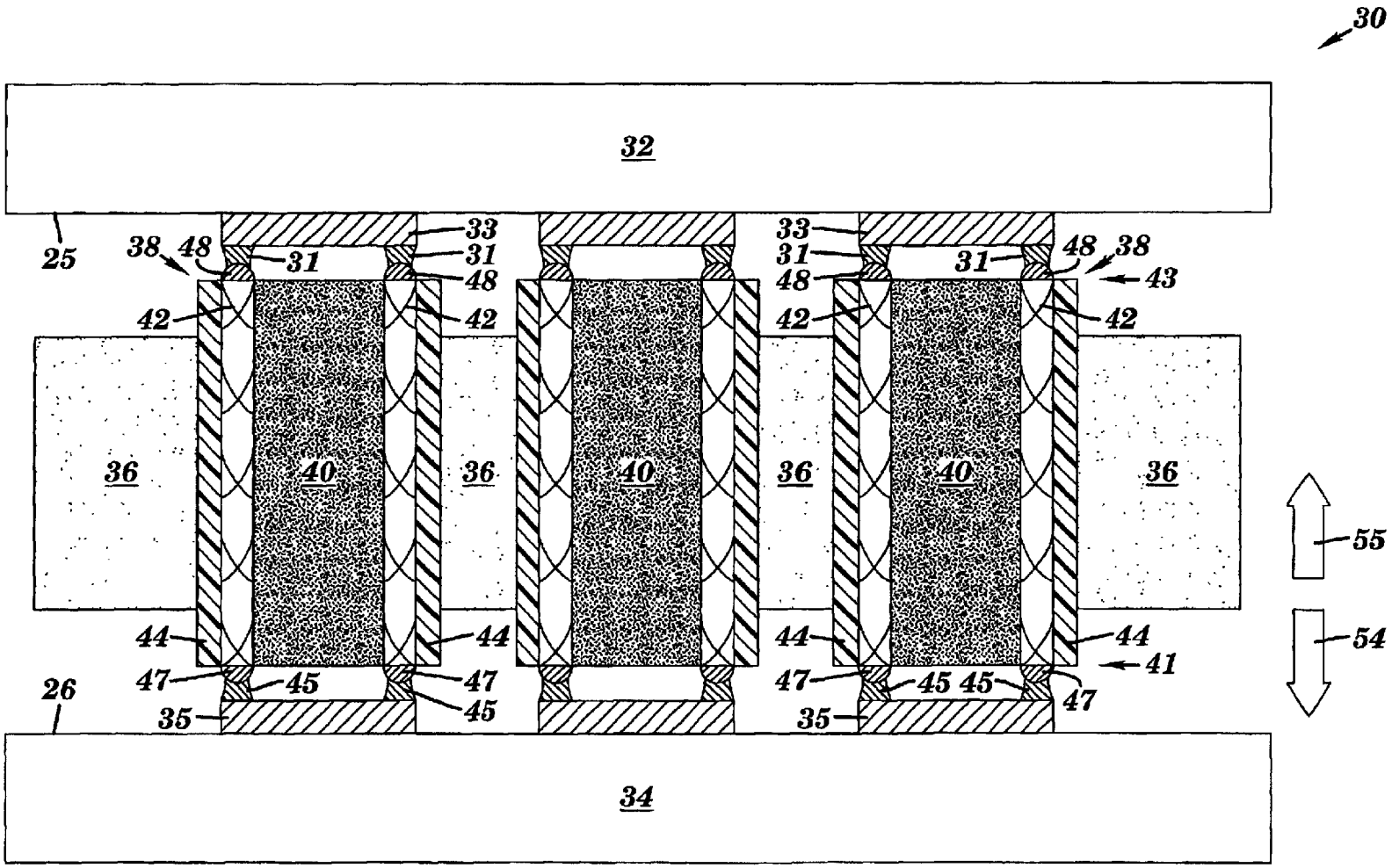
FIG. 14 depicts FIG. 13 after conductive buttons have been soldered to the other of the two substrates, in accordance with embodiments of the present invention.

As an additional embodiment, FIG. 14 depicts FIG. 13 after end contacts 47 of conductive buttons 38 have been soldered to the pads 35 of the substrate 34, in accordance with embodiments of the present invention. In FIG. 14, a solder interface 45 mechanically and conductively couples the end contacts 47 to the pads 35. Note that the force 46 (see FIG. 13) is not present in FIG. 14, because the solder interfaces 31 and 45 cause the end contacts 48 and 47, respectively, to be permanently attached (mechanically and conductively) to the pads 33 and 35, respectively. As an example, the permanent solder connection between the end contacts 47 to the pads 35 may be effectuated after the electrical structure 30 has been successfully tested.

While embodiments of the present invention have been described herein for purposes of illustration, many modifications and changes will become apparent to those skilled in the art. Accordingly, the appended claims are intended to encompass all such modifications and changes as fall within the true spirit and scope of this invention.

What is claimed is:

1. An electrical structure comprising a conductive button, said conductive button including:

a dielectric core; and a conductive wiring helically wound circumferentially around the dielectric core, wherein the conductive wiring terminates in at least two end contacts at a first end of the conductive button, and wherein the conductive wiring terminates in at least two end contacts at a second end of the conductive button, wherein the dielectric core has axial grooves along an outer surface of the dielectric core.

2. The electrical structure of claim 1, wherein being helically wound includes being served.

3. The electrical structure or claim 1, wherein being helically wound includes being served.

4. The electrical structure of claim 1, wherein being helically wound includes being helically wound in no more than one rotational direction, and wherein the one rotational direction is selected from the group consisting of a clockwise direction and a counter clockwise direction.

5. The electrical structure of claim 1, wherein the conductive wiring has a diameter between about 1 mil and about 5 mils.

6. The electrical structure of claim 1, wherein the conductive wiring includes a conductive material selected from the group consisting of copper, a copper alloy, nickel, palladium, and platinum.

7. The electrical structure of claim 1, wherein the dielectric core includes a dielectric material having a hardness between about 37 A and about 56 D on a Shore scale.

8. An electrical structure comprising a conductive button, said conductive button including:

a dielectric core; and a conductive wiring helically wound circumferentially around the dielectric core, wherein the conductive wiring terminates in at least two end contacts at a first end of the conductive button, wherein the conductive wiring terminates in at least two end contacts at a second end of the conductive button, wherein the at least two end contacts at the first end of the button are raised so as to extend beyond the dielectric core in a first direction parallel to an axis of the button, wherein the at least two end contacts at the second end of the button are raised so as to extend beyond the dielectric core in a second direction parallel to the axis of the button, and wherein the second direction is opposite the first direction, wherein the dielectric core has an axial through hole at a radial center of the dielectric core.

9. The electrical structure of claim 8, wherein being helically wound includes being helically wound in no more than one rotational direction, and wherein the one rotational direction is selected from the group consisting of a clockwise direction and a counter clockwise direction.

10. The electrical structure of claim 8, wherein a portion of the conductive wiring is at a helical angle between about 30 degrees and about 60 degrees with respect to an axis of the button.

11. An electrical structure comprising a conductive button, said conductive button including:

a dielectric core; and a conductive wiring helically wound circumferentially around the dielectric core, wherein the conductive wiring terminates in at least two end contacts at a first end of the conductive button, and wherein the conductive wiring terminates in at least two end contacts at a second end of the conductive button; and an outer dielectric jacket around the conductive wiring, wherein at least one end contact at the first end of the button is at a node of two wires of the conductive wiring.

12. The electrical structure of claim 11, wherein the dielectric core has a foamed structure.

13. The electrical structure of claim 8, further comprising an outer dielectric jacket around the conductive wiring.

14. The electrical structure of claim 8, wherein being helically wound includes being braided or served.

15. The electrical structure of claim 11, wherein the conductive wiring includes a conductive material selected from the group consisting of copper, a copper alloy, nickel, palladium, and platinum.

16. The electrical structure of claim 11, wherein the at least two end contacts of the conductive wiring at the first end of the button are coated with a noble metal.

17. The electrical structure of claim 11, wherein the conductive wiring has a diameter between about 1 mil and about 5 mils.

18. The electrical structure of claim 11, wherein the end contacts at the first end of the button each have a non-planar surface.

19. The electrical structure of claim 11, wherein the end contacts at the first end of the button each have a surface concavity toward the conductive button.

20. The electrical structure of claim 11, wherein the end contacts at the first end of the button each have a sharp edge.

21. The electrical structure of claim 11, wherein the dielectric core includes a first dielectric material having a hardness between about 37 A and about 56 D on a Shore scale, and wherein the dielectric jacket includes a second dielectric material having a hardness between about 37 A and about 56 D on a Shore scale.

22. The electrical structure of claim 11, wherein the dielectric core includes a first dielectric material, wherein the dielectric jacket includes a second dielectic material, and wherein the second dielectric material and the first dielectric material each include a same dielectric material.

23. The electrical structure of claim 11, wherein at least one of the dielectric core and the dielectric jacket includes polytetrafluoroethylene or expanded polytetrafluoroethylene.

24. The electrical structure of claim 11, wherein the dielectric core has an axial through hole at a radial center of the dielectric core.

25. The electrical structure of claim 11, wherein the dielectric core has a diameter between about 10 mils and about 20 mils.

26. The electrical structure of claim 11, wherein the dielectric core and the dielectric jacket each shrink in length during exposure to heat or ultraviolet radiation.

27. The electrical structure of claim 11, wherein the dielectric core and the dielectric jacket bond together during exposure to heat or ultraviolet radiation.

28. The electrical structure of claim 11, wherein the dielectric core, the dielectric jacket, and the conductive wiring are each compressible in the direction that is parallel to the axis of the button.

29. The electrical structure of claim 11, further comprising:

a first substrate having a conductive pad; and a second substrate having a conductive pad, wherein the at least two end contacts at the first end of the conductive button are in mechanical and electrical contact with the conductive pad of the first substrate, and wherein at least two end contacts at the second end of the conductive button are in mechanical and electrical contact with the conductive pad of the second substrate.

30. The electrical structure of claim 29, wherein the first substrate includes a printed wiring board, and wherein the second substrate includes an electronic module.

31. The electrical structure of claim 29, wherein being helically wound includes being braided or being served.

32. The electrical structure of claim 29, wherein the dielectric core, the dielectric jacket, and the conductive wiring are each sufficiently compressible so as to accommodate up to about 8 mils of composite variability that includes a planarity of a surface of the first substrate and a planarity of a surface of the second substrate which is opposite the surface of the first substrate.

33. The electrical structure of claim 29, further comprising a dielectric place holder that holds the button, wherein the place holder is disposed between the first substrate and the second substrate.

34. The electrical structure of claim 33, wherein the button is friction held by the place holder, molded to the place holder, or glued to the place holder.

35. The electrical structure of claim 29, wherein the mechanical and electrical contact with the conductive pad of the first substrate and with the conductive pad of the second substrate is maintained by a force upon each said pad, said force directed toward the button from each said pad.

36. The electrical structure of claim 35, wherein the electrical structure is clamped, and wherein the force upon each said pad results from the electrical structure being clamped.

37. The electrical structure of claim 29, wherein the mechanical and electrical contact with the conductive pad of the first substrate is maintained by a force upon each said pad, said force directed toward the button from each said pad, and wherein the at least two end contacts at the second end of the conductive button are solderably coupled to the conductive pad of the second substrate.

38. An electrical structure comprising a conductive button, said conductive button including:

a dielectric core;

a conductive wiring helically wound circumferentially around the dielectric core, wherein the conductive wiring terminates in at least two end contacts at a first end of the conductive button, wherein the conductive wiring terminates in at least two end contacts at a second end of the conductive button, wherein the at least two end contacts at the first end of the button are raised so as to extend beyond the dielectric core in a first direction parallel to an axis of the button, wherein the at least two end contacts at the second end of the button are raised so as to extend beyond the dielectric core in a second direction parallel to the axis of the button, and wherein the second direction is opposite the first direction; and and outer dielectric jacket around the conductive wiring, wherein the dielectric core has axial grooves along an outer surface of the dielectric core.

39. A method for forming an electrical structure comprising:

providing a dielectric core;

forming axial grooves along an outer surface of the dielectric core;

helically winding a conductive wiring circumferentially around the dielectric core; and cutting at an angle to an axis of the dielectric core, through the conductive wiring and through the dielectric core, at two locations along the axis, leaving a conductive button between the two locations as having a first end and a second end, wherein the conductive wiring terminates in at least two end contacts at the first end, and wherein the conductive wiring terminates in at least two end contacts at the second end.

40. The method of claim 39, wherein the helically winding includes braiding.

41. The method of claim 39, wherein the helically winding includes serving.

42. The method of claim 39, wherein the helically winding includes helically winding in no more than one rotational direction, and wherein the one rotational direction is selected from the group consisting of a clockwise direction and a counter clockwise direction.

43. The method of claim 39, further comprising forming an axial through hole at a radial center of the dielectric core.

44. The method of claim 39, further comprising:

forming an outer dielectric jacket around the conductive wiring.

45. The method of claim 44, wherein the helically winding includes braiding or serving.

46. The method of claim 44, wherein the helically winding includes helically winding in no more than one rotational direction, and wherein the one rotational direction is selected from the group consisting of a clockwise direction and a clockwise direction.

47. The method of claim 39, wherein the helically winding includes helically winding a portion of the conductive wiring at a helically angle between about 30 degrees and about 60 degrees with the respect to an axis of the button.

48. The method of claim 39, further comprising coating the at least two end contacts of the conductive wiring at the first end of the button with a noble metal.

49. The method of claim 39, wherein the cutting includes cutting by lasering.

50. The method of claim 39, wherein the cutting includes cutting by electrical discharge machining (EDM).

51. The method of claim 39, further comprising:

providing a first substrate and a second substrate;

mechanically and electrically coupling the at least two end contacts at the first end of the button to a conductive pad of the first substrate; and mechanically and electronically coupling the at least two end contacts at the second end of the button to a conductive pad of the second substrate.

52. The method of claim 51, wherein the first substrate includes a printed wiring board, and wherein the second substrate includes an electronic module.

53. The method of claim 51, further comprising:

after the cutting, placing the button in a dielectric place holder such that place holder holds the button in place; and disposing the place holder between the first substrate and the second substrate.

54. The method of claim 53, wherein placing the button into the place holder includes friction fitting, holding, or gluing the button into the place holder.

55. The method of claim 51, further comprising:

after forming the dielectric jacket and prior to the cutting, placing the electronic structure of the dielectric jacket, conductive wiring, and dielectric core in a dielectric place holder such that place holder holds the electronic structure in place; and after the cutting, disposing the place holder between the first substrate and the second substrate.

56. The method of claim 55, wherein placing the button into the place holder includes friction fitting, holding, or gluing the button into the place holder.

57. The method of claim 51, wherein the dielectric core, the dielectric jacket, and the conductive wiring are each sufficiently compressible so as to accommodate up to about 8 mils of composite variability that includes a planarity of a surface of the first substrate and a planarity of a surface of the second substrate which is opposite the surface of the first substrate.

58. The method of claim 51, wherein mechanically and electrically coupling the at least two end contacts at the first end of the button to the conductive pad of the first substrate and mechanically and electrically contacting the at least two end contacts at the second end of the button to the conductive pad of the second substrate includes maintaining a force upon each said pad, said force directed toward the button from each said pad.

59. The method of claim 58, wherein maintaining the force upon each said pad includes clamping the electrical structure such that the force upon each said pad results from the electrical structure being clamped.

60. The method of claim 51, wherein mechanically and electrically coupling the at least two end contacts at the first end of the button to the conductive pad of the first substrate includes maintaining a force upon the conductive pad of the first substrate and upon the conductive pad of the second substrate, said force directed toward the button from each said pad, wherein mechanically and electrically coupling the at least two end contacts at the first end of the button to the conductive pad of the first substrate included solderably coupling the at least two end contacts at the first end of the button to the conductive pad of the first substrate, and wherein mechanically and electrically coupling the at least two end contacts at the second end of the button to the conductive pad of the second substrate includes solderably coupling the at lest two end contacts at the second end of the button to the conductive pad of the second substrate.

61. The method of claim 39, wherein the end contacts at the first end of the button each have a non-planar surface.

62. The method of claim 39, wherein the end contacts at the first end of the button each have a surface concavity toward the conductive button.

63. The method of claim 39, wherein the end contacts at the first end of the button each have a sharp edge.

64. The method of claim 39, wherein the dielectric core includes a first dielectric material, and wherein the dielectric jacket includes a second dielectric material, and wherein the second dielectric material and the first dielectric material each include a same dielectric material.

65. A method for forming an electrical structure; comprising:

providing a dielectric core;

forming axial grooves along an outer surface of the dielectric core;

helically winding a conductive wiring circumferentially around the dielectric core; and cutting at an angle to an axis of the dielectric core, through the conductive wiring and through the dielectric core, at two locations along the axis, leaving a conductive button between the two location as having a first end and a second end, wherein the conductive wiring terminates in at least two end contacts at the first end, and wherein the conductive wiring terminates in at least two end contacts at the second end;

forming an outer dielectric jacket around the conductive wiring; and forming axial grooves along an outer surface of the dielectric core.

66. A method for forming an electrical structure; comprising:

providing a dielectric core;

forming axial grooves along an outer surface of the dielectric core;

helically winding a conductive wiring circumferentially around the dielectric core; and cutting at an angle to an axis of the dielectric core, through the conductive wiring and through the dielectric core, at two locations along the axis, leaving a conductive button between the two location as having a first end and a second end, wherein the conductive wiring terminates in at least two end contacts at the first end, and wherein the conductive wiring terminates in at least two contacts at the second end;

forming an outer dielectric jacket around the conductive wiring; and forming an axial through hole at a radial center of the dielectric core.

67. A method for forming an electrical structure; comprising:

providing a dielectric core;

helically winding a conductive wiring circumferentially around the dielectric core;

forming an outer dielectric jacket around the conductive wiring; and cutting at an angle to an axis of the dielectric core, through the dielectric jacket and through the conductive wiring and through the dielectric core, at two locations along the axis, leaving the conductive button between the two location as having a first end and a second end, wherein the conductive wiring terminates in at least two end contacts at the first end, and wherein the conductive wiring terminates in at least two end contacts at the second end, wherein the cutting includes cutting through a node of two wires of the conductive wiring.

* * * * *